US006972727B1

(12) United States Patent
West et al.

(10) Patent No.: US 6,972,727 B1
(45) Date of Patent: Dec. 6, 2005

(54) ONE-DIMENSIONAL AND TWO-DIMENSIONAL ELECTRONICALLY SCANNED SLOTTED WAVEGUIDE ANTENNAS USING TUNABLE BAND GAP SURFACES

(75) Inventors: James B. West, Cedar Rapids, IA (US); John C. Mather, Cedar Rapids, IA (US); Don L. Landt, Marion, IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 10/458,481

(22) Filed: Jun. 10, 2003

(51) Int. Cl.[7] ..... H01Q 13/22; H01P 1/18

(52) U.S. Cl. ..... 343/771; 343/778; 333/157; 333/161; 333/164

(58) Field of Search ..... 333/161, 156, 333/157, 164; 343/771, 778

(56) References Cited

U.S. PATENT DOCUMENTS

| | | | | |
|---|---|---|---|---|
| 5,170,140 | A | 12/1992 | Lowe et al. | |
| 5,309,165 | A | 5/1994 | Segal et al. | |
| 5,309,166 | A * | 5/1994 | Collier et al. | 343/778 |
| 5,426,403 | A | 6/1995 | La Lau et al. | |
| 5,786,792 | A | 7/1998 | Bellus et al. | |
| 5,845,391 | A | 12/1998 | Bellus et al. | |
| 5,977,925 | A * | 11/1999 | Hamnen et al. | 343/771 |
| 6,175,337 | B1 * | 1/2001 | Jasper, Jr. et al. | 343/771 X |
| 6,518,930 | B2 | 2/2003 | Itoh et al. | 343/767 |
| 6,552,691 | B2 | 4/2003 | Mohuchy et al. | |
| 6,650,291 | B1 | 11/2003 | West et al. | |
| 6,756,866 | B1 | 6/2004 | Higgins | |

OTHER PUBLICATIONS

*Antenna Engineering Handbook*, Johnson and Jasik Eds.Chapter 9, *Slot-Array Antennas*, Hung Yuet Yee, pp. 9-1 through 9-37, McGraw-Hill, NY, NY, 1984. ,

*The Handbook of Design, vol. 2*, Rudge, Milne, Olver, and Knight, Chapter 10, *Planar Arrays*, R.C. Hanson, pp. 161-169, Peter Peregrinus Ltd, London, UK, 1983.

*Low Series Resistance GaAs Schottky Diode Development and GaAs Waveguide Sidewall Simulation Report*, by Xin Hao, Milestone Document for DARPA FCS Program: High Band 37-GHz Beam Forming Active Array Antenna System for Future Combat Systems Applications, Rockwell Scientific Company, Feb., 2002.

"Characteristics of Ka Band Waveguide Using Electromagnetic Crystal Sidewalls", by J. A. Higgins et al., 2002 IEEE MTT-S International Microwave Symposium, Seattle, WA, Jun. 2002.

*FCS_Demo_1_Presentation_02_09_02_jbw*, by J.B. West and J.P. Doane, Final Test Report (Power Point Presentation) for Rockwell Collins work on DARPA FCS Demo-1 Beam Former Phased Scanned Lens, Feb. 9, 2002.

(Continued)

*Primary Examiner*—Benny T. Lee
(74) *Attorney, Agent, or Firm*—Nathan O. Jensen; Kyle Eppele

(57) ABSTRACT

An electronically scanned slotted waveguide antenna radiates an RF signal as a scannable beam. The antenna has radiation waveguides positioned in an array. Radiation slots in the radiation waveguides radiate the scannable beam. A feed waveguide is coupled to the radiation waveguides. The feed waveguide feeds the RF signal to the radiation waveguides through coupling slots. The feed waveguide has sidewalls with tunable electromagnetic crystal (EMXT) structures thereon. The EMXT structures vary the phase of the RF signal in the feed waveguide to scan the radiated beam in one dimension. The radiation waveguides may also have tunable EMXT structures on the sidewalls to vary the phase of the RF signal to scan the radiated beam in a second dimension. The EMXT structures may be discrete EMXT devices or a EMXT material layer covering the feed and radiation waveguide sidewalls.

13 Claims, 16 Drawing Sheets

OTHER PUBLICATIONS

*Waveguide Slot Array Design*, by I. Kaminow and R. Stegen, Technical Memorandum 348, Hughes Aircraft Company, Microwave Laboratory, Research and Development Laboratories, 1954.

*C-Slot; a Practical Solution for Phased Arrays of Radiating Slots Located on the Narrow Side of Rectangular Waveguides*, by T. Sphicopoulos, Proceedings of the IEE, vol. 120 Part H, No. 2, 1982, pp. 49-55.

*Compact Resonant Slot for Waveguide Arrays*, by R.J. Chingel and J. Roberts, Proceedings of the IEE, vol. 125, No. 11, Nov. 1978, pp. 1213-1216.

*Microwave Antenna Theory and Design*, S. Silver, pp. 287-301, Peter Peregrinus Ltd, London, UK, 1984.

Patent Application for "A Method and Structure for Phased Array Antenna Interconnect", by John C. Mather, Christina M. Conway, and James B. West, U.S. Appl. No. 10/273,459, filed Oct. 18, 2002.

* cited by examiner

ONE-DIMENSIONAL AND TWO-DIMENSIONAL ELECTRONICALLY SCANNED SLOTTED WAVEGUIDE ANTENNAS USING TUNABLE BAND GAP SURFACES

CROSS REFERENCE TO RELATED APPLICATIONS

The present application is related to co-pending application Ser. No. 10/273,459 and filed on Oct. 18, 2002 entitled "A Method and Structure for Phased Array Antenna Interconnect" invented by John C. Mather, Christina M. Conway, and James B. West. The co-pending application is incorporated by reference herein in its entirety. All applications are assigned to the assignee of the present application.

BACKGOUND OF THE INVENTION

This invention relates to antennas, phased array antennas, and specifically to one- and two-dimensional electronically scanned slotted waveguide antennas using tunable photonic band gap structures.

A slotted waveguide antenna array is very attractive for certain applications such as weather and fire control radar, where very high radiation efficiency and low cross-polarization levels are required. An overview of the basic design methodology for slotted waveguide arrays is presented in Johnson, R. C., and Jasik, H. Eds., *Antenna Engineering Handbook*, Chapter 9, Slot-Array Antennas, Hung Yuet Yee, pp. 9-1 through 9-31, McGraw-Hill, NY, N.Y., 1984. FIG. 1 illustrates a prior art waveguide antenna array 10 with radiation waveguides 11 having slots 12 that radiate a beam. FIG. 2 illustrates a prior art slotted waveguide antenna array 15 with a basic series feed waveguide 17. The feed waveguide 17 excites each radiation waveguide 11 in the waveguide antenna array 10. Slots 18 are feed coupling slots that couple to the radiation waveguides 11. Four radiation waveguides 11 are shown in FIGS. 1 and 2 for discussion purposes but a larger number are typically used.

A slotted waveguide array 15 is typically passive; i.e., it stares at bore sight and does not scan. One-dimensional phased arrays, where the radiation beam is electronically scanned in one direction (e.g., azimuth or elevation), have been implemented with PIN diode and ferrite waveguide phase shifters within the feed manifold of these types of antennas. Both parallel and series phase shifting feeds have been demonstrated as disclosed in Rudge, A. W., Milne, K, Olver, A. D., Knight, P., *The Handbook of Antenna Design, Volume* 2, Chapter 10, *Planar Arrays*, R. C. Hanson, Peter Peregrinus, Ltd, London, UK, 1983, pp. 161–169.

The parallel feed approach is attractive because standard phase shifter technologies with commercially available waveguide flanges can be easily integrated into the feed network. Parallel feed antennas are unattractive for certain applications such as commercial weather radar since they suffer high weight and consume substantial volumetric real estate on the back side of the radiation aperture. Antenna thickness is an issue for commercial aircraft since the nose radome swept volume requirement limits the aperture size due to the ±90° mechanical scanning requirement in azimuth. The thinner the antenna assembly, the larger the aperture that can be moved in azimuth for a given radome swept volume.

Series feed waveguides 17 shown in FIG. 2 are attractive since they are simple and physically compact. Most contemporary forward staring, non-monopulse waveguide antennas use this type of feed. It is essentially impractical to integrate PIN diode phase shifters within a series feed waveguide 17 due to bias interconnect complexity and limited space for high quality waveguide-to-coax-to-microstrip transitions. PIN diode phase shifters are unattractive due to higher insertion loss in the on state, low isolation in the off state. Ferrite loaded series feeds have been demonstrated and are attractive because they can be designed to be very low loss. Their disadvantages include the high peak current required to change the ferrite materials' remnant magnetization to realize phase shifting, temperature dependence that requires an elaborate calibration scheme, and the slow switching speed required for reciprocal operation.

What is required is a high-performance, high-manufacturability, and cost-effective one-dimensional and two-dimensional slotted waveguide phased array using tunable photonic band gap (PBG), electromagnetic band gap, or electromagnetic crystal substrates as phase shifting waveguide walls.

SUMMARY OF THE INVENTION

An electronically scanned slotted waveguide antenna for radiating an RF signal as a scannable beam is disclosed. The antenna comprises a plurality of radiation waveguides positioned in an array. The radiation waveguides have radiation slots that radiate the scannable beam. A feed waveguide is coupled to the plurality of radiation waveguides. The feed waveguide feeds the RF signal to the radiation waveguides through coupling slots. The feed waveguide sidewalls have tunable electromagnetic crystal (EMXT) structures on the sidewalls. The EMXT structures vary the phase of the RF signal in the feed waveguide to scan the radiated beam.

The EMXT structures may be discrete EMXT devices mounted on substrate slats. The substrate slats further comprise a substrate, interconnect traces for interconnecting the EMXT devices and an external control, a dielectric layer over the interconnect traces for providing insulation, and a metal shield layer over the interconnect traces for providing an RF shield. The substrate slats are mounted to the feed waveguide sidewalls with the EMXT devices mounted in openings in the sidewalls. Alternately the feed waveguide sidewalls may be covered with an EMXT material layer.

The radiation waveguides may have sidewalls having tunable EMXT structures thereon. The EMXT structures vary phase of the RF signal in the radiation waveguides to scan the radiated beam. The EMXT structures may be discrete EMXT devices mounted on substrate slats. A substrate slat is mounted to each of the radiation waveguide sidewalls with the EMXT devices mounted in openings in the sidewalls. The EMXT structures may comprise an EMXT material layer covering each radiation waveguide sidewall.

It is an object of the present invention to provide high-performance, high-manufacturability, and cost-effective one-dimensional and two-dimensional slotted waveguide phased arrays using tunable photonic band gap (PBG) substrates as phase shifting waveguide walls.

It is an object of the present invention to provide slotted waveguide phased array antennas for weather and fire control radar, collision avoidance, communications systems, and SATCOM applications with a scannable beam.

It is an advantage of the present invention to apply electromagnetic crystal structures on sidewalls of a feed waveguide to provide phase shifting to scan a beam.

It is an advantage of the present invention to apply electromagnetic crystal structures on sidewalls of radiation waveguides to provide phase shifting to scan a beam.

It is a feature of the present invention to provide one- and two-dimensional scanning of a beam.

It is a feature of the present invention to provide an antenna that is scalable from L-band through 50+GHz for commercial and military applications.

BRIEF DESCRIPTION OF THE DRAWINGS

The invention may be more fully understood by reading the following description of the preferred embodiments of the invention in conjunction with the appended drawings wherein.

DETAILED DESCRIPTION

The invention described herein utilizes electromagnetic crystal (EMXT) lined waveguide sidewalls to achieve phase shifting required for electronic scanning of one-dimensional and two-dimensional slotted waveguide antennas.

Figure 3:
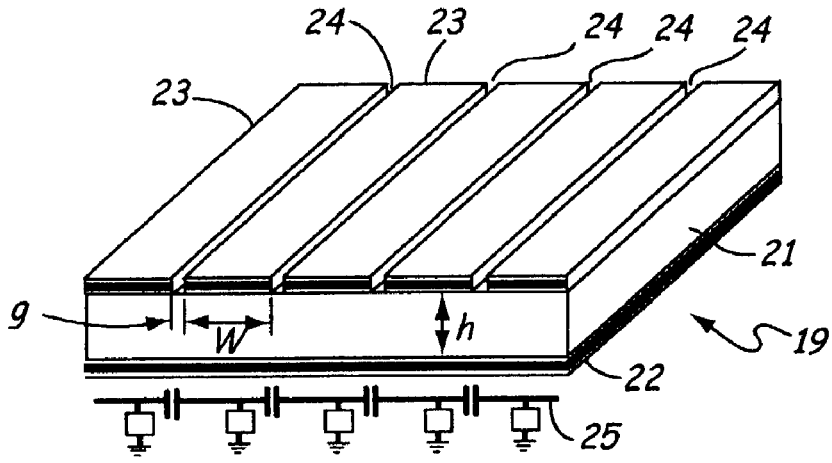
FIG. 3 shows a typical EMXT structure used in the present invention.

EMXT devices are also known as tunable photonic band gap (PBG) and tunable electromagnetic band gap (EBG) substrates in the art. The Rockwell Scientific Company, Inc. (RSC) has developed waveguide phase shifting technologies that utilize tunable EBG substrates as waveguide walls. A detailed description of a waveguide section with tunable EBG phase shifter technologies is available in a paper by J. A. Higgins et al. "Characteristics of Ka Band Waveguide using Electromagnetic Crystal Sidewalls" 2002 IEEE MTT-S International Microwave Symposium, Seattle, Wash., June 2002. A typical EMXT structure 19, shown in FIG. 3, is described in the referenced paper. Other similar structures may be implemented based on design requirements. Electromagnetic band gap (EBG) materials are periodic dielectric materials that forbid propagation of electromagnetic waves in a certain frequency range. The EBG material may be GaAs, ferroelectric, ferromagnetic, or any suitable EBG embodiment. Other future currently unknown EBG substrate embodiments are also applicable to the present invention.

In the EMXT structure 19 of FIG. 3, a thin dielectric substrate 21 is metallized completely on one side 22 and has stripes 23 of metal or other conducting material separated by narrow gaps 24 of width g on the other side. The substrate 21 may be any low loss material. The gap 24 acts as a capacitance and the substrate 21 thickness h and the stripe 23 width w provide an inductance to ground as shown in an equivalent circuit 25. At certain frequencies, as determined by the substrate 21 tuning, incident waves are reflected from the EMXT structure 19.

For ferroelectric and ferromagnetic tunable EBG substrates 21 used in the EMXT structure 19, the grounded dielectric substrate 21 of FIG. 3 is realized by one of many methods known in the art. Here dielectric constant and permeability are varied with a DC bias applied to the conducting stripes 23 to tune the EMXT structure 19. Metal deposition techniques are used to form the required top-side metallic geometries and back side bias control signal line interconnections.

Figure 4:
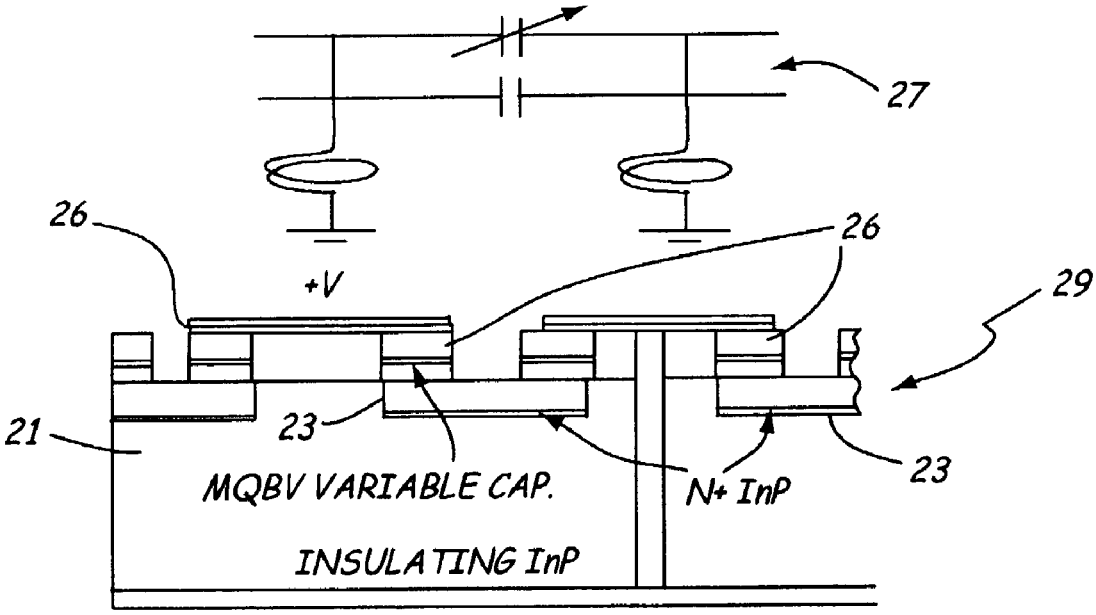
FIG. 4 illustrates an EMXT structure with tunable Schotkky diodes.

A tunable EMXT structure 19 may also be implemented in semiconductor MMIC (monolithic microwave integrated circuit) technology as described in the referenced paper and in a report by Xin, Hao, *Low Series resistance GaAs Schottky Diode Development and GaAs Waveguide Sidewall Simulation* Report Milestone Document for Following DARPA FCS Program: High Band, 37-GHz Beam Forming Active Array Antenna System for Future Combat Systems Applications, Prepared by Rockwell Scientific Company (RSC), February, 2002. Gallium arsenide (GaAs) and indium phosphide (InP) semiconductor substrates 21 are currently practical, but other III-V compounds are feasible. In these implementations the semiconductor substrate 21 acts as a passive (non-tunable) dielectric material, and tunability is obtained with traditional semiconductor devices, such as varactor or Schotkky diodes 26 in FIG. 4 connected across conducting stripes 23. The diodes 26 within the EMXT structure 19 (see FIG. 3) are reverse biased to provide a variable capacitance as a function of applied voltage. These variable capacitances modulate the surface impedance of the EMXT structure 19 to generate phase shift across the wave that reflects off its surface. An equivalent circuit 27 is shown in FIG. 4. The semiconductor device tuning elements, the top side metal geometries and the back side bias control signal line interconnections are all realized by means of commonly known semiconductor fabrication techniques.

Figure 1:
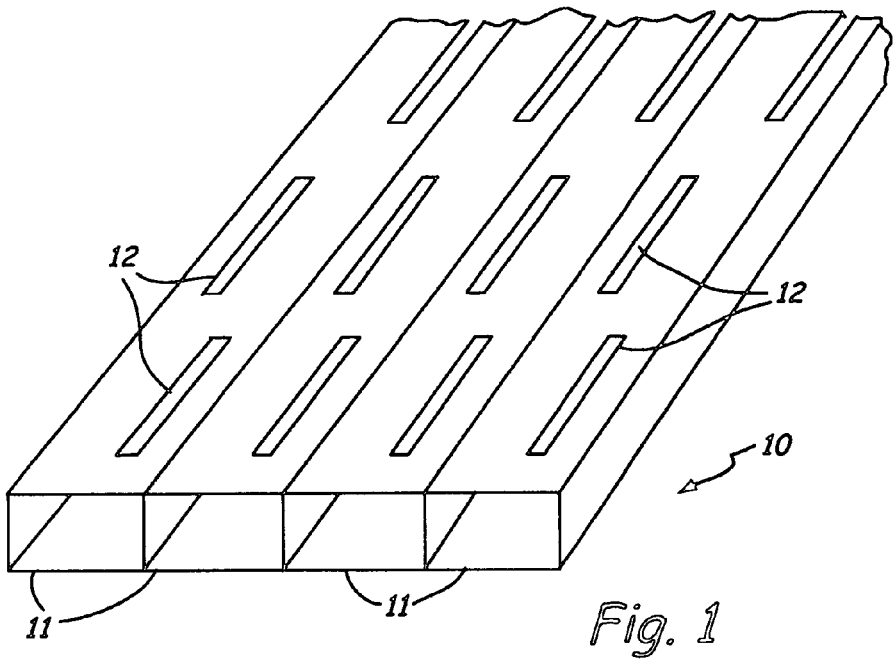
Fig. 1 (PRIOR ART)
FIG. 1 is a diagram of a prior art waveguide antenna array with radiation waveguides having slots that radiate a beam.
Figure 2:
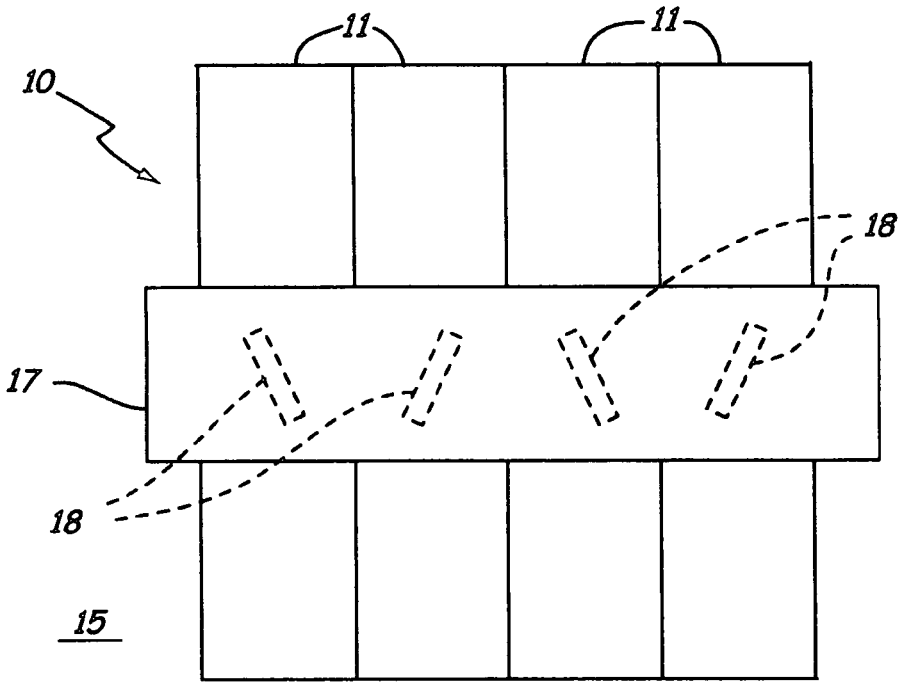
Fig. 2 (PRIOR ART)
FIG. 2 illustrates a prior art slotted waveguide antenna array with a basic series feed waveguide.
Figure 5:
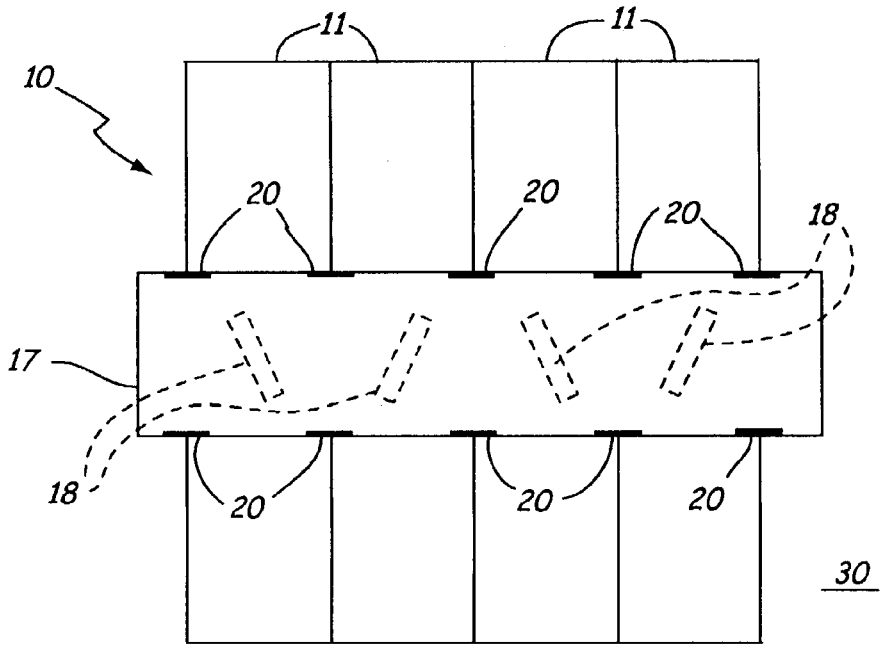
FIG. 5 shows a first embodiment of an electronically scanned slotted waveguide antenna of the present invention.

A first embodiment of an electronically scanned slotted waveguide antenna 30 of the present invention is shown in FIG. 5. The slotted waveguide antenna array 15 of FIG. 2 is modified with tunable EMXT structures 19 of FIG. 3 or diode EMXT structures 29 of FIG. 4 implemented as discrete EMXT devices 20 embedded in the feed waveguide 17 sidewalls to generate phase shift along the axis of the feed waveguide 17 to scan a beam when a variable bias is applied. In FIG. 5 four radiation waveguides 11 in waveguide antenna array 10 are again shown but a larger number with a correspondingly longer feed waveguide 17 may be used and still be within the scope of the present invention. The feed waveguide 17 may be a narrower band, high efficiency resonant feed or a broadband lower efficiency traveling wave feed, both of which are commonly known in the art. The feed waveguide 17 sections that contain the coupling slots 18 to couple to the radiation waveguides 11 are classic $TE_{10}$ waveguide sections and intervening waveguide sections contain the EMXT devices 20 as shown in FIG. 5. It is initially desirable to retain the traditional $TE_{01}$ slot coupling theory in the design of the antenna array 30 because waveguide slot design data for TEM waveguide structures are not documented within the literature. It is certainly possible, however, to generate such design data, as discussed below.

Figure 6:
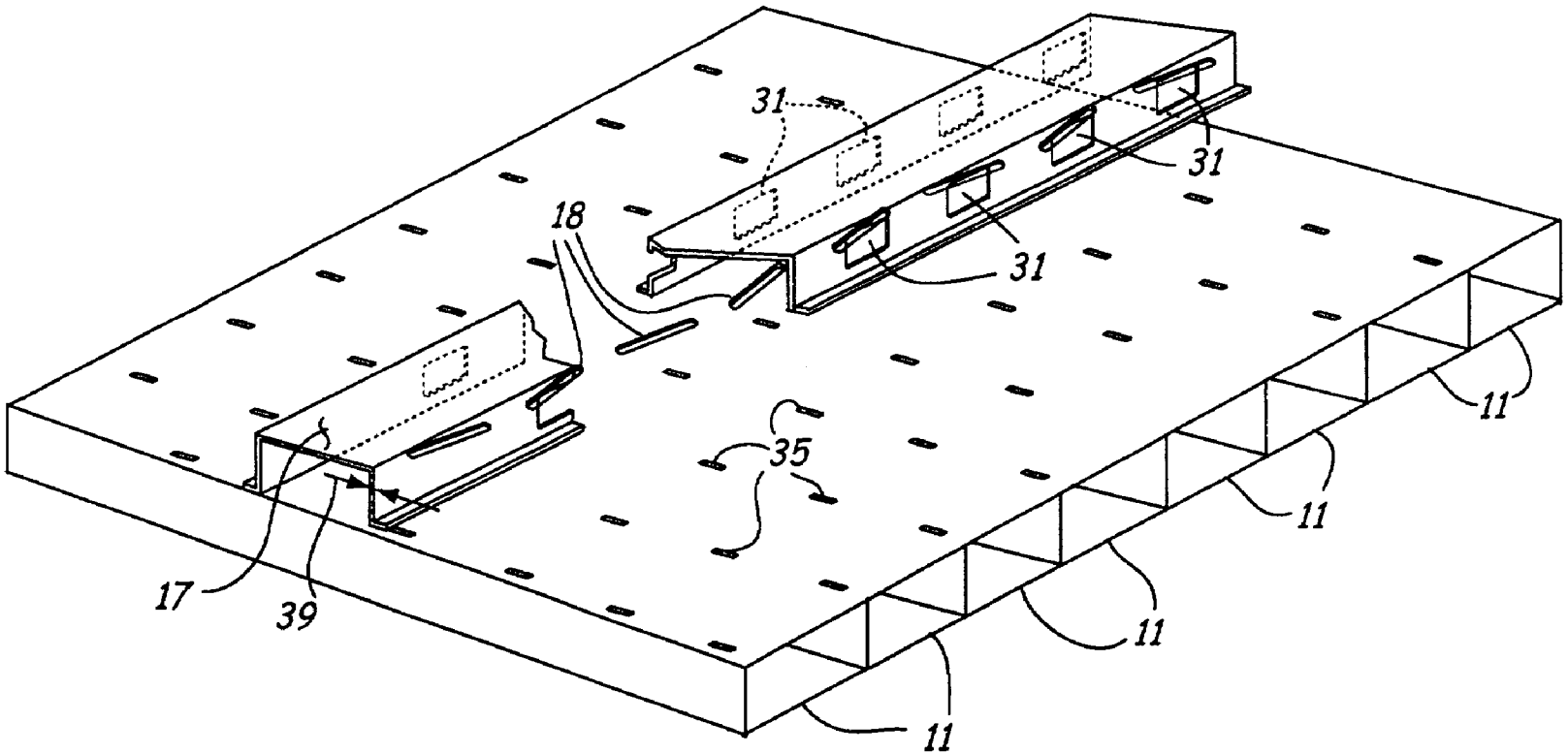
FIG. 6 illustrates a mechanical approach for implementing the antenna array of FIG. 5.

The antenna array 30 of FIG. 5 can be implemented using a mechanical approach shown in FIG. 6. The feed waveguide 17 is part of a back side of the radiating waveguides 11. Radiating waveguides 11 have sidewall tabs 35 used to construct the antenna as shown. The sidewall tab 35 method shown is one of several ways to construct the radiation waveguides 11. The radiation waveguides 11 can be milled out or constructed out of extruded tubes, for example. The feed waveguide 17 can be end fed or center fed with an RF signal to be radiated by the antenna array 30. A feed (not shown) to the feed waveguide 17 can be an E plane, H plane, or Magic T waveguide feed known in the art. The feed waveguide 17 design is such that the discrete EMXT devices 20 can be located in waveguide sidewall openings 31 between the coupling slots 18, as discussed above and indicated in FIG. 6. As noted in FIG. 6, the feed waveguide 17 wall thickness 39 is selected to be compatible with the EMXT device 20 thickness and mounting method, to ensure that the edges of the EMXT device 20 are not exposed to an incident RF field within the waveguide 17. This is necessary to prevent parasitic surface wave mode excitation within the EMXT devices 20.

Figure 7:
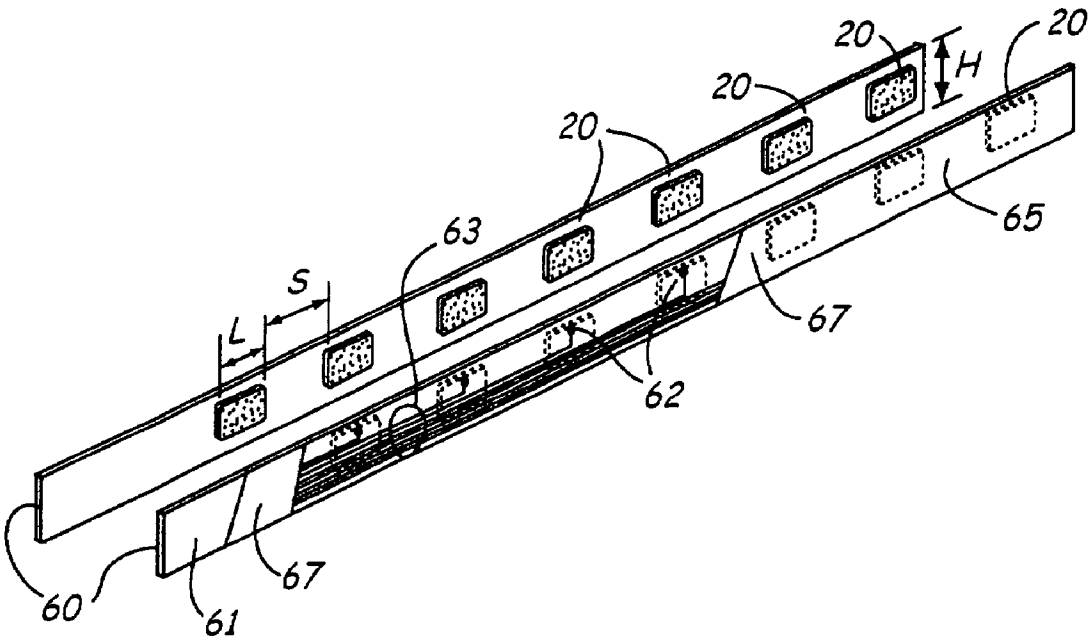
FIG. 7 shows interconnect substrate slats used to mount EMXT devices as disclosed in co-pending U.S. Application Ser. No. 10/273,459.

FIG. 7 shows interconnect substrate slats 60 as disclosed in the co-pending U.S. application Ser. No. 10/273,459. The substrate slats 60 are shown in both front and back views with EMXT devices 20 attached. The interconnect substrate slats 60 have a substrate 61 that provides for mechanical mounting of the EMXT devices 20 as well as for electrical interconnect traces 63 between each EMXT device 20 and an external electronic control function (not shown) that controls the phase shift and the antenna array 30 scanning by applying a variable bias. Metalized vias and pads 62 may be used to interconnect on the opposite side of the substrate 61. Interconnect traces 63 are shielded by a metal layer 65 insulated by a dielectric layer 67 to eliminate any negative effects from extraneous RF radiation and immunity to electromagnetic interference (EMI). Note that the H dimension of the substrate slat 60 can be adjusted as needed to facilitate connection of external control circuitry outside of the feed waveguide 17. The EMXT device 20 length L and the space S between adjacent EMXT device 20 edges are also design variables.

Figure 8:
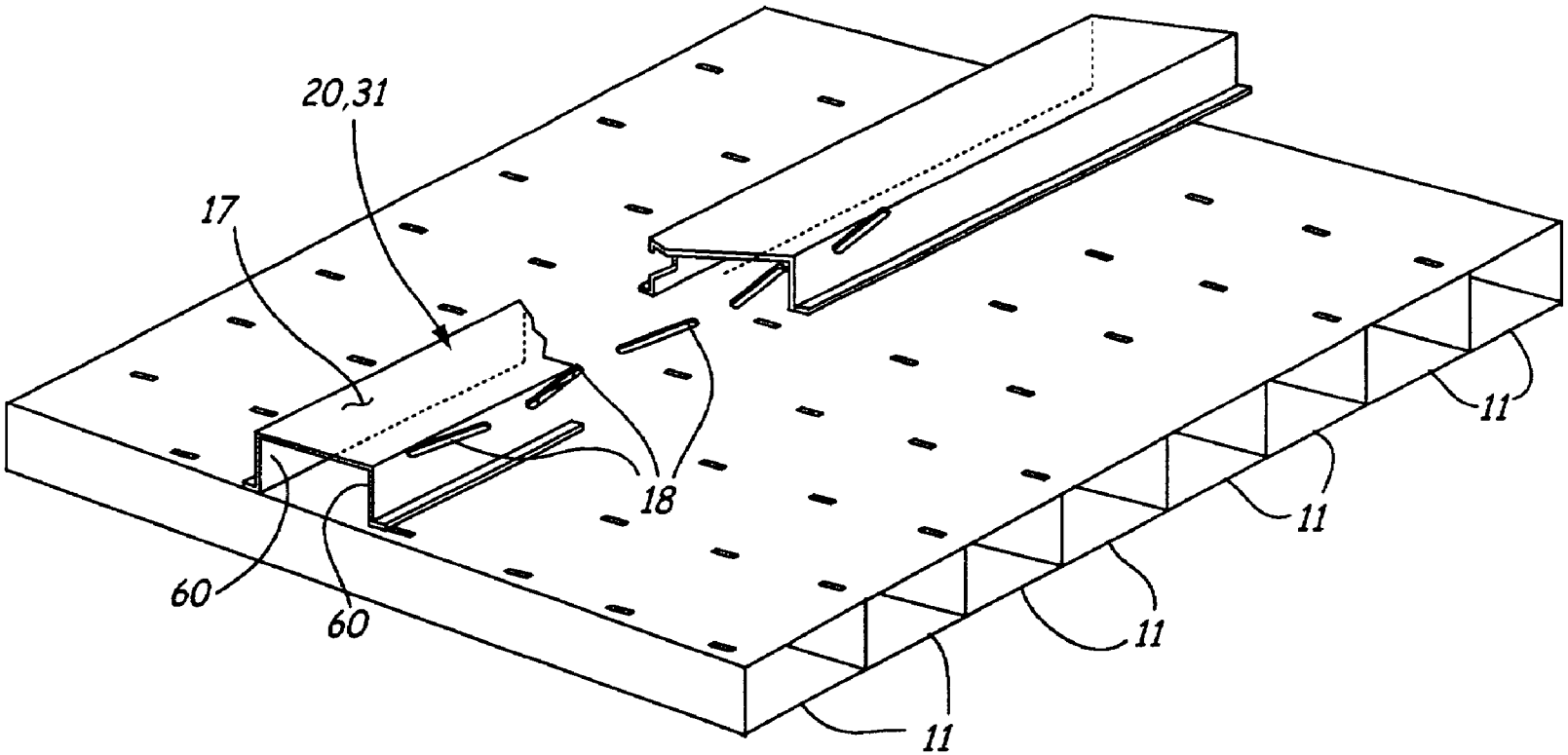
FIG. 8 depicts the electronically scanned slotted waveguide antenna array with the substrate slats of FIG. 7 set in position on the feed waveguide of FIG. 6.

FIG. 8 depicts the electronically scanned slotted waveguide antenna array 30 with the substrate slats 60 of FIG. 7 set in position on the feed waveguide 17 of FIG. 5. The substrate slats 60 are mounted to the outer surfaces of the feed waveguide with the EMXT devices 20 fitting into the openings 31 in the sidewalls of the feed waveguide 17. As indicated earlier, the interconnect substrate slat 60 length and/or width dimension may be adjusted to facilitate connection of the bias and ground traces to the necessary external control circuitry (not shown). The interconnect substrate slats 60 may be secured to the feed waveguide 17 using adhesive, mechanical, or other methods or combinations of methods.

Figure 9:
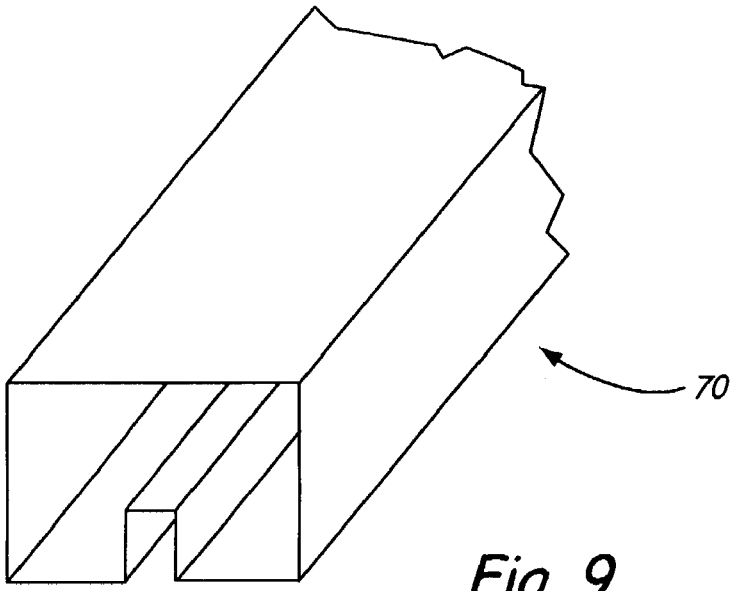
FIG. 9 is a drawing showing a single ridge waveguide that may be used as a feed waveguide in the present invention.

Several factors interplay in the design of a phase shifting feed. Each coupling slot 18 along the feed waveguide 17 that couples to each radiation waveguide 11 must be located at a voltage standing wave maximum. In addition, the radiation waveguide 11 spacing along a radiation aperture, as shown in FIGS. 3 and 7, affects coupling slot 18 spacing along the feed waveguide 17. These factors set the cross sectional dimensions of the feed waveguide 17, determine if feed waveguide dielectric loading is required, or if a single ridge waveguide 70 is required in the feed design, as shown in FIG. 9. The ridge waveguide 70 has the feature of having a lower cut off frequency relative to a standard rectangular waveguide for the same cross sectional width and dielectric loading. The cross sectional dimensions of the EMXT device waveguide section and the $TE_{10}$ waveguide sections are appropriately adjusted to maintain a constant characteristic impedance (Zo) through the feed waveguide 17 to facilitate an impedance matched condition.

The ultimate phase shift realizable in the electronically scanned slotted waveguide antenna array 30 feed waveguide 17 may be restricted by the coupling slot 18 spacing since the amount of phase shift is a function of the length of a given tunable EMXT device 20. Other types of feed coupling slot 18 configurations may provide additional benefit as discussed below. A second embodiment 80 shown in FIG. 10 removes this limitation. The entire surface of each feed waveguide 17 sidewall is effectively completely lined with an EMXT material layer 85. The EMXT material layer 85 can be applied by deposition of ferroelectric or ferromagnetic material with metallization or can be a ceramic or crystal configuration. The EMXT material layer 85 is made up of the EMXT structure 19 (see FIG. 3) or diode EMXT structure 29 (see FIG. 4) of the appropriate size to cover the feed waveguide sidewall. The coupling coefficient of the coupling slots 18 to the radiation waveguides 11, as a function of slot rotation from the feed waveguide 17 axis, and the resonant length for each slot rotation angle, are not characterized within the literature. However, electrical slot characterization can be accomplished with modern EM field solvers such as ANSOFT HFSS, or alternatively through careful experimental characterization and curve fitting, or a combination of the two.

Figure 11:
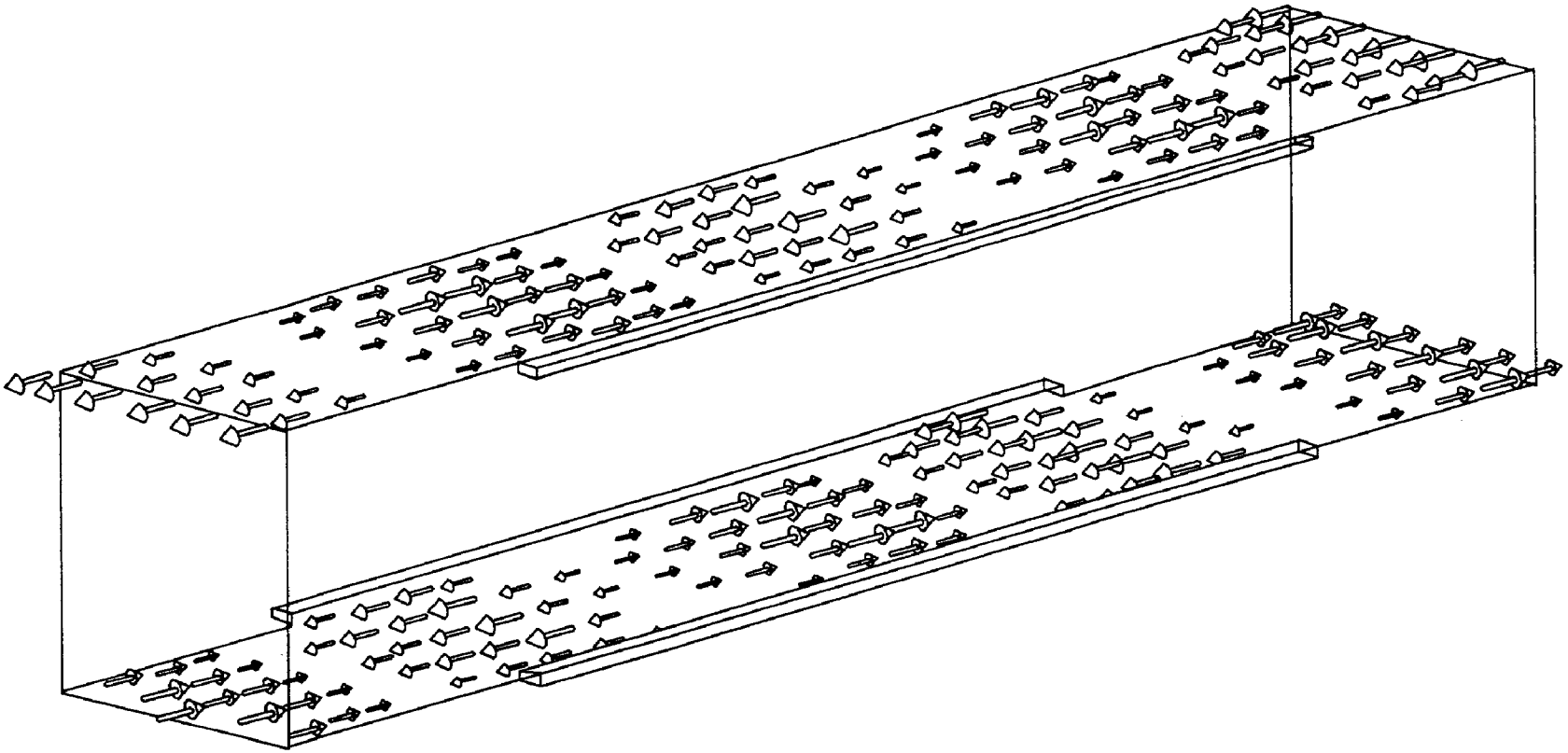
FIG. 11 illustrates a surface current density on interior surfaces of a 38 GHz TEM waveguide with InP semiconductor sidewalls for rectangular waveguide narrow walls.
Figure 12:
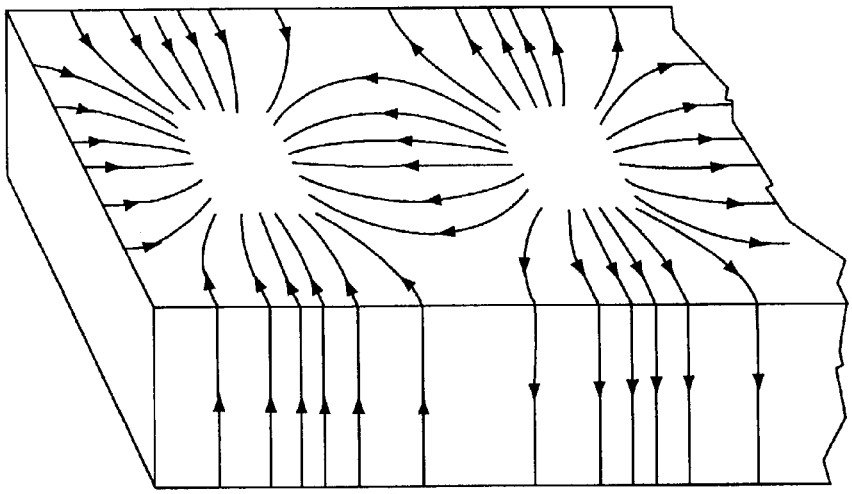
FIG. 12 shows the current flow of a $TE_{01}$ waveguide.

FIG. 11 illustrates a simulation of $J_s$, a surface current density on interior surfaces of a 38-GHz TEM waveguide with InP (Indium Phosphide) semiconductor sidewalls for rectangular waveguide narrow walls. The arrows in FIG. 11 indicate the surface current density $J_s$, The change in direction of the arrows indicates a $\lambda/2$ phase reversal and the size of the arrows indicates relative magnitude of the surface current density. This simulation is useful to illustrate various electromagnetic concepts used in the present invention for a scanned slotted waveguide antenna. Although this simulation is specifically for an InP varactor diode-based EMXT, the pattern of the current density is more general than the embodiment. Two things are noteworthy in this simulation: the very small surface current density along the sidewalls, and the axial current in the waveguide top and bottom walls. The low sidewall current is indicative of a high RF impedance. Theoretically, a lossless EMXT TEM waveguide is an embodiment of a parallel-plate waveguide of infinite transverse dimensions that has zero sidewall current. The axial current flow of the EMXT waveguide in FIG. 11 is different than that of a classic $TE_{10}$ waveguide, as shown in FIG. 12, but a series inclined slot is sufficient to interrupt current flow, which in turn generates coupling from the feed waveguide 17 into the radiation waveguides 11.

Figure 10:
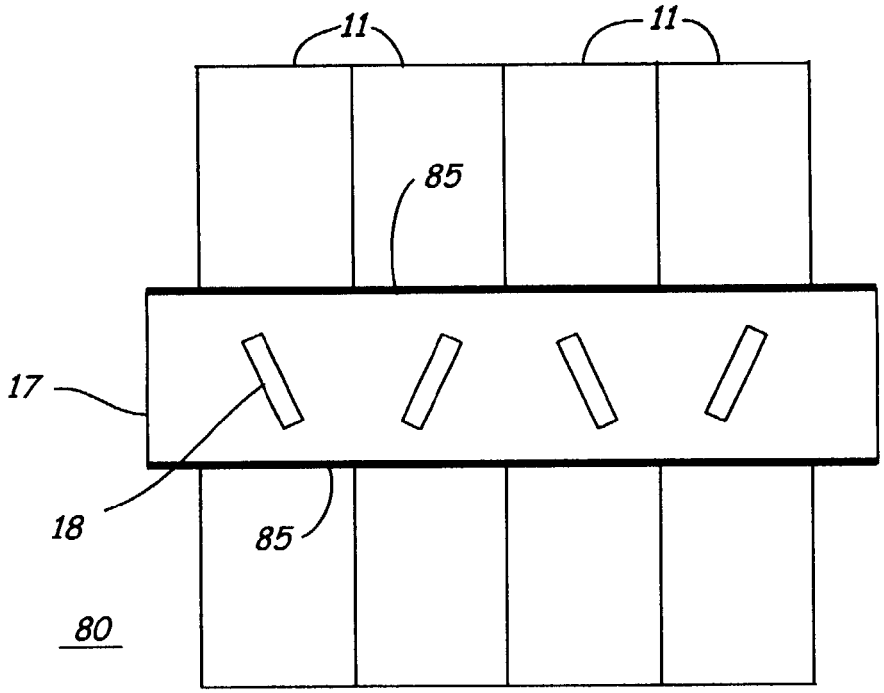
FIG. 10 shows a second embodiment of the present invention wherein the entire surface of each feed waveguide sidewall is effectively completely lined with a EMXT material layer.

The radiation waveguides 11 in FIGS. 3 and 10 can be center fed as shown or end-fed, by means of the feed waveguide 17 by moving the feed waveguide 17 from the center to an end (not shown). For the center-fed case, the EMXT phase shifting range will have to be such that the phase across the radiation waveguide 11 array centerline will be symmetric in magnitude but opposite in sign. If a 180° power splitter is used for a center feed at the center of feed waveguide 17, an additional 180° phase offset is required across the two halves of the feed waveguide 17. For the end-fed case, a constant phase gradient across the feed waveguide 17, where each phase setting along the EMXT waveguide sections is the same, is required to steer a beam to a given position.

The one-dimensional electronically scanned slotted waveguide antenna 30 and 80 shown in FIGS. 3 and 10 can be expanded to two-dimensional electronic beam scanning by placing tunable EMXT waveguide sidewalls within each radiation slot waveguide 11, in addition to incorporating the phase shifting EMXT feed waveguide 17 previously described. A two-dimensional electronically scanned slotted waveguide antenna 90 is shown in FIG. 13.

All of the electrical considerations applicable to the feed waveguide 17 design also come into play in the design of a radiation waveguide 91 with continuous EMXT material 95 sidewalls. Radiation waveguide slots 92 are positioned on voltage standing wave peaks, which are typically spaced by ½ waveguide wavelength ($\lambda_g/2$). This spacing also determines a grating lobe-free scan area along the axis of the waveguides 91. The cross section of the radiation waveguide 91 limits the beam scan area along the radiation waveguide 91 axis. The slot 92 spacing constraint is in addition to that of beam scan area limitations in a plane perpendicular to the radiation waveguide 91, where beam scanning is initiated by the phase shifting feed waveguide 17, as previously described. The radiation waveguide 91 cross section and dielectric loading are again design parameters. The cross sectional dimensions of the feed waveguide 17 EMXT sections and the $TE_{10}$ waveguide sections are appropriately adjusted to maintain a constant characteristic impedance (Zo) through the feed waveguide 17 to facilitate an impedance matched condition. It is also possible to use single ridged waveguide 70 to make the cross section of the radiation waveguide smaller than that of the traditional $TE_{10}$ waveguide for the same operating frequency, similar to that shown in FIG. 9.

Figure 13:
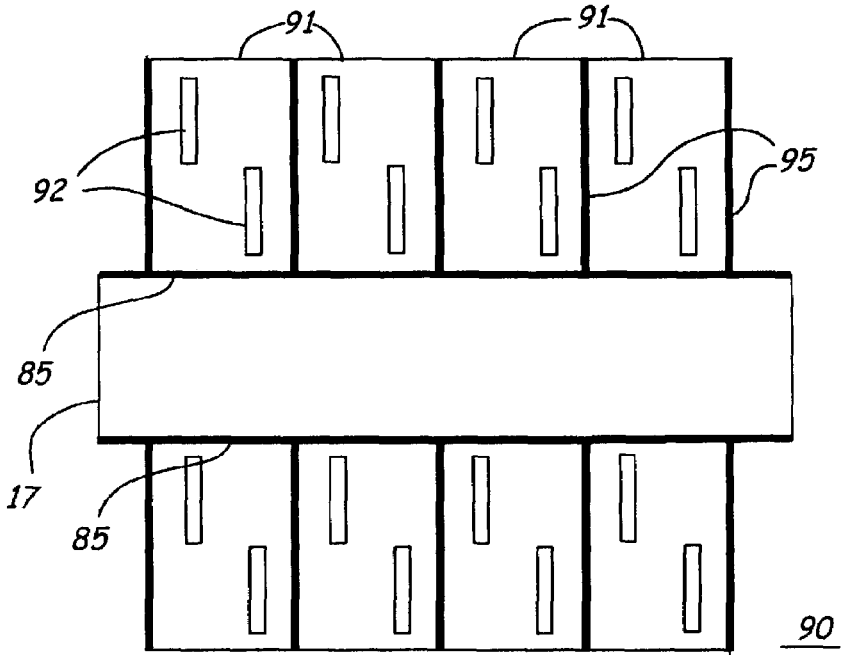
FIG. 13 is a diagram of a two-dimensional electronically scanned slotted waveguide antenna.

FIG. 13 illustrates radiation waveguides 91 with continuous EMXT material 95 sidewalls, similar to the feed waveguide 17 with EMXT material 85 shown in FIG. 10. The radiation waveguide 91 may incorporate segmented EMXT and $TE_{01}$ waveguide sections between the radiation slots 92, similar to the feed waveguide 17 shown in FIG. 5. The segmented radiation waveguide 91 retains the classic $TE_{10}$ waveguide-to-free space radiation coupling of a standard broad wall slotted waveguide antenna, if sufficient phase shift along the radiation waveguide 91 can be realized for a given application. Since the broad wall current of a TEM waveguide is axial in nature, as previously shown in FIG. 11, the $TE_{10}$ broad wall longitudinal slot is an inefficient radiator since such a slot may not sufficiently interrupt the axial waveguide current flow to $1^{st}$ order. A classic edge slot shown in Kaminow, I,., and Stegen, R. F., *Wavegulde Slot Array Design*, Technical Memorandum 348, Hughes Aircraft Company, Microwave Laboratory, Research and Development Laboratories, 1954; "C" slot shown in Sphicopoulos, T., *C-Slot; a practical solution for phased arrays of radiating slots located on the narrow side of rectangular wave guides*, Proceedings of the IEE, Volume 120 Part H, No. 2,1982, pp. 49–55; "H" or "I" slot shown in Chingel, R. J., Roberts, J., Compact resonant slot for waveguide arrays, Proceedings of the IEE, Volume 125, Number 11, November, 1978, pp. 1213–1216; probe-fed slot Silver, S., *Microwave Antenna Theory and Design*, Peter Peregrinus, Ltd. London, UK, 1984, pp. 287–301; and other types are more appropriate choices. Since these slots will be operating in a TEM mode rather than the $TE_{01}$ mode as documented in the literature, electrical slot characterization of such radiation slot structures can be accomplished with modern EM field solvers such as ANSOFT HFSS, or alternatively through careful experimental characterization and curve fitting.

Although the slotted feed waveguide 17 and radiation waveguide 91 are emphasized in this disclosure, the concept of a tunable EMXT waveguide is applicable to the more general case of a phase shifting waveguide feed manifold that excites other types of radiating elements, e.g., open ended waveguides, probe coupled dipoles, and many others. Creating radiation waveguides with EMXT sidewalls is accomplished using an approach similar to that described above for the feed waveguide 17.

Figure 14:
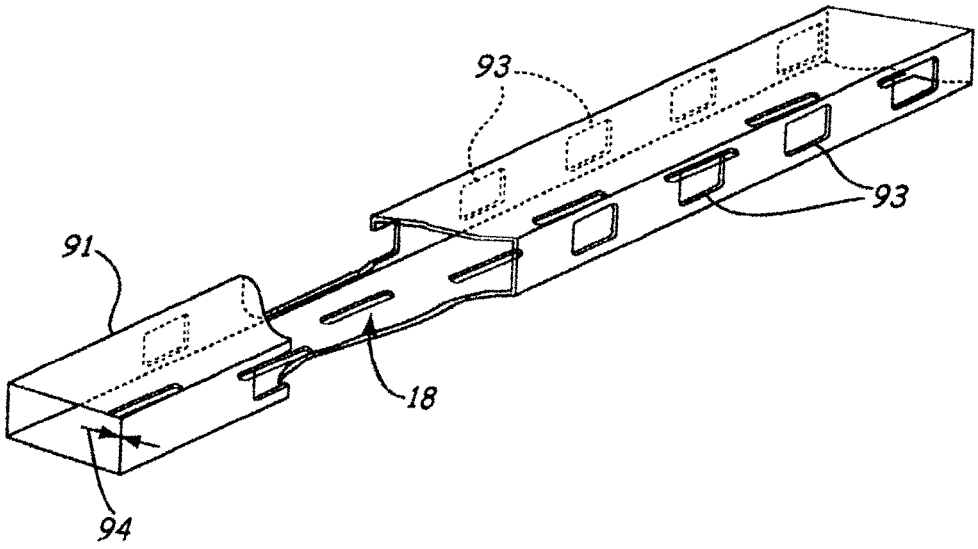
FIG. 14 shows an isometric cut-away sketch with a viewing perspective similar to FIG. 6 of a radiation waveguide.

FIG. 14 shows an isometric cut-away sketch with a viewing perspective similar to FIG. 6 of a radiation waveguide 91 that has openings 93 for discrete EMXT devices 20 in waveguide sidewall locations between the radiation slots 18. As noted in FIG. 6, the radiation waveguide 91 wall thickness 94 is selected to be compatible with the EMXT device 20 thickness and mounting method, to ensure that the edges of the EMXT device 20 are not exposed to the incident RF field within the waveguide.

Figure 15:
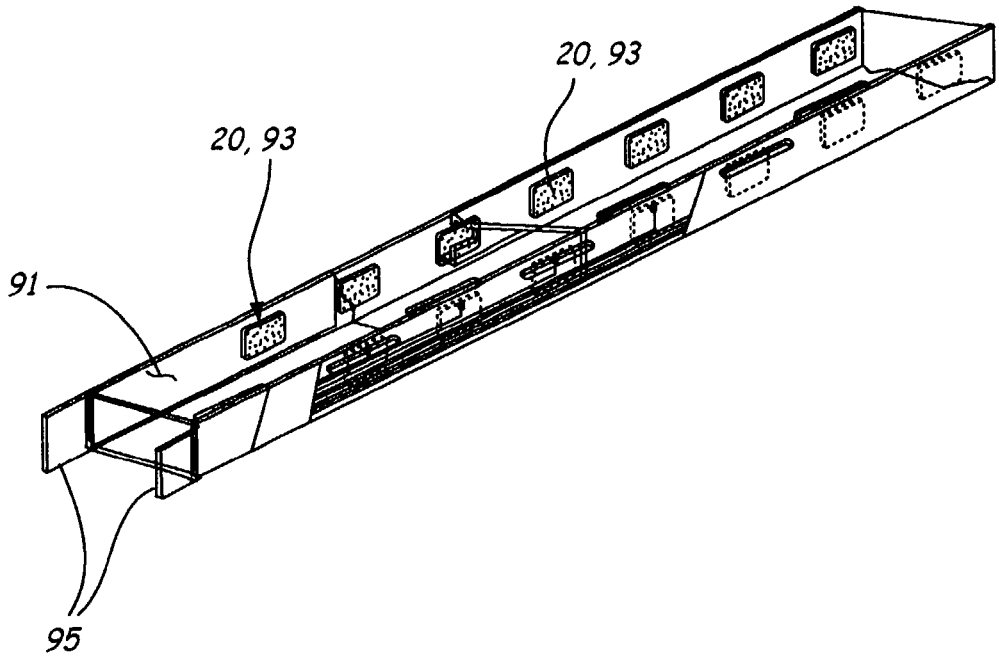
FIG. 15 depicts EMXT substrate slats that may be similar or identical to the substrate slats shown in FIG. 7 set in position on the radiation waveguide of FIG. 14.

FIG. 15 depicts EMXT substrate slats 95 that may be similar or identical to the substrate slats 60 shown in FIG. 7 set in position on the radiation waveguide 91 of FIG. 14. The EMXT devices 20 fit into the openings 93 in the sidewalls of the radiation waveguide 91. As indicated earlier, the interconnect substrate slat 95 length and/or width dimension may be adjusted to facilitate connection of bias and ground traces to the necessary external control circuitry (not shown). The EMXT substrate slats 95 may be secured to the waveguide 91 using adhesive, mechanical, or other methods or combinations of methods.

Figure 16:
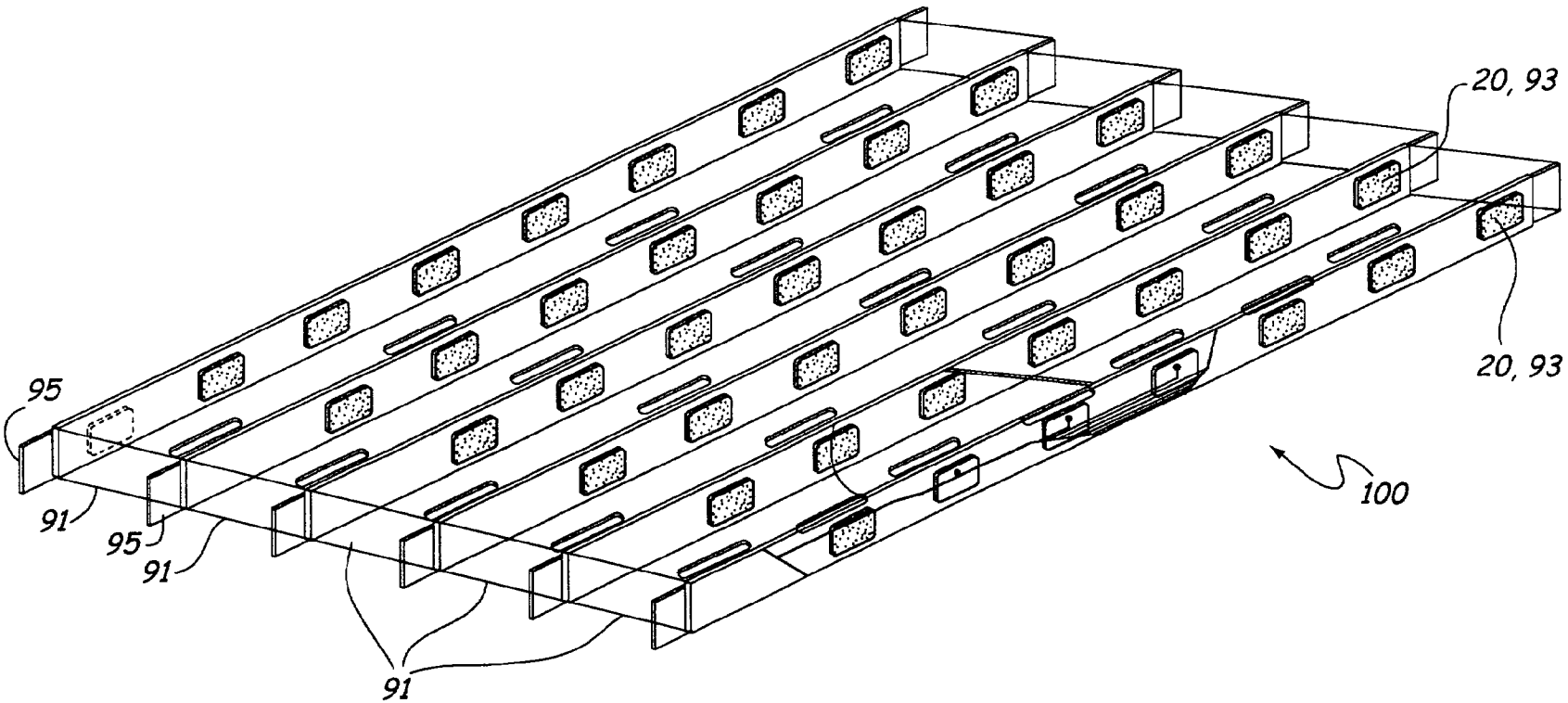
FIG. 16 shows several of the radiation waveguides of FIG. 15 grouped together to indicate how they could be arranged to create a scannable antenna array.
Figure 17:
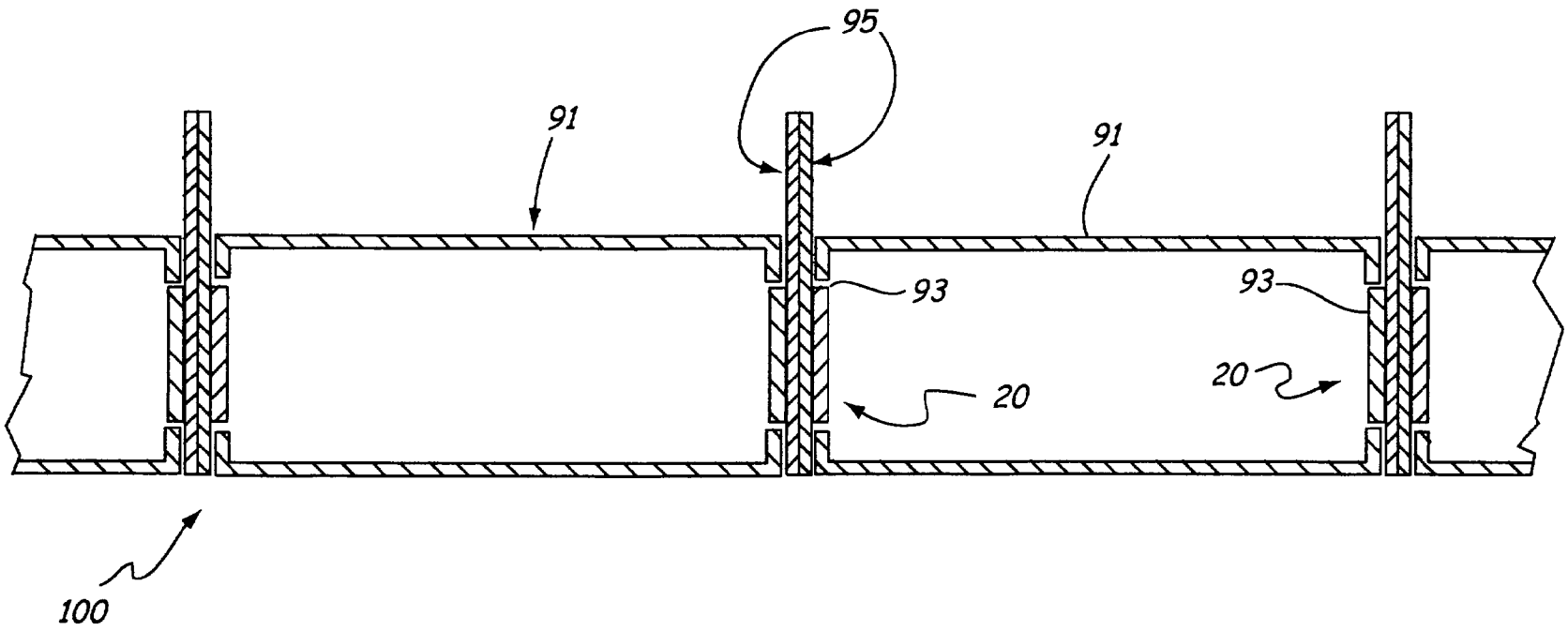
FIG. 17 is another view of the radiation waveguides of FIG. 16.

FIGS. 16 and 17 show several of the radiation waveguides 91 of FIG. 15 grouped together to indicate how they could be arranged to create a scannable antenna array 100. Substrate slats 95 are attached to the outside of each radiation waveguide with EXMT devices 20 protruding in the waveguide openings 93. The radiation waveguides 91 need to be mechanically affixed to an appropriate framework/structure (not shown) to provide for accurate positioning of each waveguide 91 and robustness of the entire assembly.

The above discussions assume that the EMXT devices 20 are assembled to an interconnect substrate slat (60 and 95) that is subsequently positioned and attached to the exterior of a waveguide (17 and 91). However, the general technical approach presented herein permits fabrication of individual waveguides containing the EMXT devices 20 and all relevant circuitry and shielding. Fabrication methods for such waveguides can include stamping and/or etching of metal sheet to provide needed slots/apertures and to enable the sheet to easily be formed into a rectangular tube. Circuitry can be applied to the surface of the metal sheet, and devices can be mechanically and electrically attached to the circuitry prior to forming the sheet into a tube. A lap joint with appropriate sealing methodology can be employed to close the waveguide tube. This approach eliminates the separate EMXT substrate slats (60 and 95) while preserving all other desirable features, including testability and repair before final assembly.

An additional variation is to make minor modifications to a present slotted waveguide antenna construction to incorporate the EMXT devices 20 and relevant circuitry on both sides of each individual partition that forms the side wall for two adjacent waveguides.

Furthermore, the approaches above are generally applicable for discrete device phase shifters (EMXT devices, MEMs, etc) of varying lengths and spacing, even approaching continuous coverage; and for continuous deposition of materials that can be activated to cause phase shift in propagating EM radiation.

It is believed that the one-dimensional and two-dimensional electronically scanned slotted waveguide antenna of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An electronically scanned slotted waveguide antenna for radiating an RF signal as a scannable beam, said antenna comprising:

a plurality of radiation waveguides positioned in an array and having radiation slots that radiate the scannable beam; and a feed waveguide coupled to the plurality of radiation waveguides wherein said feed waveguide feeds the RF signal to said radiation waveguides through coupling slots, said feed waveguide comprising sidewalls having tunable electromagnetic crystal (EMXT) structures thereon, said EMXT structures for varying a phase of the RF signal in said feed waveguide to scan the radiated beam in a first dimension; wherein said EMXT structures comprises a continuous EMXT material layer covering each feed waveguide sidewall.

2. An electronically scanned slotted waveguide antenna for radiating an RF signal as a scannable beam, said antenna comprising:

a plurality of radiation waveguides positioned in an array and having radiation slots that radiate the scannable beam; and a feed waveguide coupled to the plurality of radiation waveguides, wherein said feed waveguide feeds the RF signal to said radiation waveguides through coupling slots, said feed waveguide comprising sidewalls with substrate slats having discrete tunable electromagnetic crystal (EMXT) devices thereon, said EMXT devices varying a phase of the RF signal in said feed waveguide to scan the radiated beam in a first dimension, wherein each one of said substrate slats further comprise:

a substrate for mechanical mounting of the EMXT devices;

interconnect traces for interconnecting the EMXT devices and an external control;

a dielectric layer over the interconnect traces for providing insulation; and a metal shield layer over the interconnect traces for providing an RF shield.

3. The electronically scanned slotted waveguide antenna for radiating an RF signal as a scannable beam of claim 2, wherein a respective substrate slat is mounted to each of said feed waveguide sidewalls with said corresponding EMXT devices mounted in openings in said sidewalls.

4. An electronically scanned slotted waveguide antenna for radiating an RF signal as a scannable beam, said antenna comprising:

a plurality of radiation waveguides positioned in an array and having radiation slots that radiate the scannable beam; and a feed waveguide coupled to the plurality of radiation waveguides wherein said feed waveguide feeds the RF signal to said radiation waveguides through coupling slots, said feed waveguide comprising:

sidewalls having tunable electromagnetic crystal (EMXT) devices thereon, said EMXT devices for varying a phase of the RF signal in said feed waveguide to scan the radiated beam in a first dimension; and substrate slats having said EMXT devices mounted thereon wherein each one of said substrate slats further comprise a substrate for mechanical mounting of the EMXT devices, interconnect traces for interconnecting the EMXT devices and an external control; a dielectric layer over the interconnect traces for providing insulation; and a metal shield layer over the interconnect traces for providing an RF shield.

5. The electronically scanned slotted waveguide antenna for radiating an RF signal as a scannable beam of claim 4, wherein a respective substrate slat is mounted to each of said feed waveguide sidewalls with said corresponding EMXT devices mounted in openings in said sidewalls.

6. The electronically scanned slotted waveguide antenna for radiating an RF signal as a scannable beam of claim 4, wherein said radiation waveguides further comprise sidewalls having radiation waveguide tunable EMXT devices thereon, said radiation waveguide tunable EMXT devices for varying a phase of the RF signal in said radiation waveguides to scan the radiated beam in a second dimension.

7. The electronically scanned slotted waveguide antenna for radiating an RF signal as a scannable beam of claim 6, wherein said radiation waveguide tunable EMXT devices comprise a respective continuous EMXT material layer covering each radiation waveguide sidewall.

8. The electronically scanned slotted waveguide antenna for radiating an RF signal as a scannable beam of claim 6, wherein said radiation waveguide tunable EMXT devices comprise discrete tunable EMXT devices.

9. The electronically scanned slotted waveguide antenna for radiating a RF signal as a scannable beam of claim 6, wherein said radiation waveguides further comprise substrate slats having said radiation waveguide tunable EMXT devices mounted thereon.

10. The electronically scanned slotted waveguide antenna for radiating an RF signal as a scannable beam of claim 9, wherein each one of said substrate slats further comprise:

a substrate for mechanical mounting of the radiation waveguide tunable EMXT devices;

interconnect traces for interconnecting the radiation waveguide tunable EXMT devices and an external control;

a dielectric layer over the interconnect traces for providing insulation; and a metal shield layer over the interconnect traces for providing an RF shield.

11. The electronically scanned slotted waveguide antenna for radiating an RF signal as a scannable beam of claim 9, wherein a respective substrate slat is mounted to each of said radiation waveguide sidewalls with said corresponding radiation waveguide tunable EMXT devices mounted in openings in said sidewalls.

12. An electronically scanned slotted waveguide antenna for radiating an RF signal as a scannable beam, said antenna comprising:

a plurality of radiation waveguides positioned in an array and having radiation slots that radiate the scannable beam, wherein said radiation waveguides further comprise sidewalls with substrate slats having discrete radiation waveguide tunable electromagnetic crystal (EMXT) devices thereon, said discrete radiation waveguide tunable EMXT devices varying a phase of the RF signal in said radiation waveguide to scan the radiated beam in a second dimension, wherein each one of said substrate slats further comprise:

a substrate for mechanical mounting of the discrete radiation waveguide tunable EMXT devices;

interconnect traces for interconnecting the discrete radiation waveguide tunable EMXT devices and an external control;

a dielectric layer over the interconnect traces for providing insulation; and a metal shield layer over the interconnect traces for providing an RF shield; and a feed waveguide coupled to the plurality of radiation waveguides, wherein said feed waveguide feeds the RF signal to said radiation waveguides through coupling slots, said feed waveguide comprising sidewalls with substrate slats having discrete tunable EMXT devices thereon, said EMXT devices varying a phase of the RF signal in said feed waveguide to scan the radiated beam in a first dimension.

13. The electronically scanned slotted waveguide antenna for radiating an RF signal as a scannable beam of claim 12, wherein a respective substrate slat is mounted to each of said radiation waveguide sidewalls with said discrete radiation waveguide tunable EMXT devices mounted in openings in said sidewalls.

* * * * *